US006446819B1

(12) United States Patent
Mattesky

(10) Patent No.: US 6,446,819 B1
(45) Date of Patent: Sep. 10, 2002

(54) DEVICE FOR LOADING MERCHANDISE ONTO DISPLAY PEGS

(75) Inventor: Henry Mattesky, Roseland, NJ (US)

(73) Assignee: Magla Products, L.L.C., Morristown, NJ (US)

( * ) Notice: Subject to any disclaimer, the term of this patent is extended or adjusted under 35 U.S.C. 154(b) by 0 days.

(21) Appl. No.: 09/402,861

(22) PCT Filed: Apr. 9, 1998

(86) PCT No.: PCT/US98/07306

§ 371 (c)(1),
(2), (4) Date: Jan. 24, 2000

(87) PCT Pub. No.: WO98/44831

PCT Pub. Date: Oct. 15, 1998

Related U.S. Application Data

(60) Provisional application No. 60/042,832, filed on Apr. 9, 1997.

(51) Int. Cl.[7] ..... B42F 7/00

(52) U.S. Cl. ..... 211/57.1; 211/54.1; 211/59.1

(58) Field of Search ..... 211/57.1, 59.1, 211/54.1, 49.1, 4, 7, 8, 51, 59.3, 1, 13.1, 85.3; 206/493; 312/61, 71; 55/344; 24/23 EE, 20 EE, 16 PB, 115 A, 115 F, 115 K, 454, 265 R, 265 A; 248/693, 682, 551, 634

(56) References Cited

U.S. PATENT DOCUMENTS

| | | | | |
|---|---|---|---|---|
| 868,286 | A | * | 10/1907 | Munday |
| 1,478,112 | A | * | 12/1923 | Flather |
| 1,702,987 | A | * | 2/1929 | Wilson |
| 1,711,070 | A | * | 4/1929 | Suydam, Jr. |
| 2,967,611 | A | | 1/1961 | Bolinger |
| 3,148,770 | A | | 9/1964 | Cosman |
| 3,313,407 | A | | 4/1967 | Palm, Jr. |
| 3,402,435 | A | | 9/1968 | Merser |
| 3,597,803 | A | | 8/1971 | Van Neil |
| 3,638,801 | A | * | 2/1972 | Larson ..... 211/59.2 |
| 3,913,178 | A | | 10/1975 | Ballin |
| 3,952,872 | A | | 4/1976 | Consiglio, Jr. |
| 4,072,232 | A | | 2/1978 | Marsman et al. |
| 4,111,297 | A | | 9/1978 | Paulin |
| 4,301,575 | A | | 11/1981 | Goldberg |
| 4,474,300 | A | * | 10/1984 | Entis ..... 211/57.1 |
| 4,823,964 | A | * | 4/1989 | Lundberg ..... 211/57.1 |
| 5,054,727 | A | | 10/1991 | Campbell et al. |
| 5,112,014 | A | * | 5/1992 | Nichols ..... 211/57.1 |
| 5,222,608 | A | * | 6/1993 | Eklof et al. ..... 211/54.1 |
| 5,261,175 | A | * | 11/1993 | Gebka ..... 211/59.1 |
| 5,531,417 | A | * | 7/1996 | Valiulis et al. ..... 211/57.1 |
| 5,553,706 | A | * | 9/1996 | Gold ..... 211/57.1 |
| 5,632,387 | A | * | 5/1997 | Johnson ..... 211/59.1 |
| 5,678,794 | A | * | 10/1997 | Kump ..... 211/59.1 |
| 5,718,340 | A | * | 2/1998 | Nagel |
| 5,730,296 | A | | 3/1998 | Limmer |
| 5,901,860 | A | | 5/1999 | Nowicki |
| 6,131,748 | A | * | 10/2000 | Kawasaki et al. ..... 211/54.1 |

FOREIGN PATENT DOCUMENTS

| | | |
|---|---|---|
| EP | 0093988 | 11/1983 |

* cited by examiner

*Primary Examiner*—Daniel P. Stodola
*Assistant Examiner*—Jennifer E. Novosad
(74) *Attorney, Agent, or Firm*—Selitto, Behr & Kim

(57) ABSTRACT

A device for holding and facilitating the unloading therefrom of packaged merchandise onto a peg of a pegboard display includes a coupler, such as a tube segment having an open end and a closed end, and a stem having a flat segment with two ends, one of which is attached to the closed end of the tube segment. The diameter of the tube segment and the width of said flat segment may be substantially equal. The other end of the flat segment may be attached to a stop which has a width that is substantially greater than the diameter of the tube segment.

87 Claims, 3 Drawing Sheets

DEVICE FOR LOADING MERCHANDISE ONTO DISPLAY PEGS

CROSS REFERENCE TO RELATED APPLICATION

This is a §111 (a) application relating to provisional U.S. application Ser. No. 60/042,832 filed Apr. 9, 1997.

BACKGROUND OF THE INVENTION

1. Field of the Invention

The present invention relates to devices and methods for storing and deploying packaged merchandise, and in particular, to devices and methods adapted to load display pegs.

2. Discussion of the prior Art

Pegboard displays have become the supermarket display mode of choice for lightweight merchandise. It has been found however that loading merchandise onto these displays is very time consuming. Given the very narrow profit margin on which most supermarkets operate, cost saving in this activity is greatly desired. A recent solution to this problem has been the "power panel". This is a ready made package of a number of loaded pegs in a box, which is simply hung up on the available shelf wall. This mode has two disadvantages, it is expensive and does not provide a ready means of recharge if there is a substantial difference in the sales of different items in the panel. There is therefore, a demand for a way of prepackaging a number of items so that they can be readily loaded onto the pegboards as a group rather than as individual items.

U.S. Pat. No. 4,143,772 shows a device for holding and facilitating the unloading of merchandise onto a display peg. There, a plug connects by a cord through a rear hole of a cup-shaped coupler. The plug and coupler can be joined together to form a loop that holds merchandise. The coupler can be separated from the plug and connected to the end of a display peg, so that the merchandise can slide onto the peg. This coupler will not easily be secured to the peg and the reference does not suggest improvements such as shaping the coupler as an open channel (or split tube) open at one or both ends, with either end bevelled in order to facilitate installation of the coupler onto a peg. The reference also does not suggest deploying a ratchet tooth inside the coupler for gripping the peg. Furthermore, the reference does not suggest making the coupler annular or noose-like to enhance attachment to the display peg. Additionally, the reference shows a complicated, rigid molded plug and does not suggest a simple flexible or barbed stop (located either distally or proximally) or a simple intermediate (or distal) hole along the length of the device to form a loop for holding merchandise. Moreover, the reference does not suggest a cord made of wire or a flat segment attached to the closed end of a tube segment that can be easily looped to a proximal or intermediate position by tying, lassoing, or otherwise.

SUMMARY OF THE INVENTION

In accordance with the illustrative embodiments demonstrating features and advantages of the present invention, there is provided a device for holding and facilitating the unloading therefrom of packaged merchandise onto a display peg. The device has a quick release coupler having a distal opening for releasably engaging the peg. The device also has a stem attached to the coupler for holding the packaged merchandise. Also included is a securing means for releasably securing the packaged merchandise on the stem.

According to one aspect of the present invention, coupler can have a channel (or split tube) that is open along its length and sized to fit around the peg. According to another aspect of the present invention, the coupler can be: (a) at least partially bevelled at the anterior opening to extend axially in an axially asymmetric fashion by amounts that differ for positions angularly displaced around the coupler, (b) tubular with openings at an anterior and posterior end, with the stem being asymmetrically positioned to the outside of the opening at the posterior end, (c) bevelled and open at either end, or (d) annular. According to yet another aspect of the present invention, the coupler can have a tubular sleeve with at least one internal ratchet tooth for gripping the peg. According to yet still another aspect of the present invention, the stem has a distal stop (optionally flexible) distal from the coupler for impeding the release of the packaged merchandise out past the distal stop, as well as having in some cases a proximal stop proximal to the coupler for impeding release of the packaged merchandise past said proximal stop toward the coupler. According to still a further aspect of the present invention, a reentrance hole (either proximal or distal to the coupler) allows looping back in order to secure packaged merchandise on the stem. According to yet a further aspect of the present invention, this stem may have: (a) a ductile wire adapted for looping and tying in order to secure packaged merchandise on the stem, (b) a flat segment with one end attached core axially to the close posterior end of a tube segment of the coupler, or (c) a barbed plug on a distal end of the stem, sized to fit snugly into the coupler to form a loop for securing packaged merchandise on the stem.

In accordance with a related aspect of the present invention, a method employs an elongated device for storing and rapidly deploying a plurality of packaged merchandise that are each packaged with an opening suitable for loading onto a display peg. The method includes the step of storing the plurality of packaged merchandise by placing each of the openings about the elongated device. Another step is securing one end of the elongated device to the display peg. The method also includes the step of sliding the plurality of packaged merchandise off the elongated device and onto the display peg. Another included step is removing the elongated device from the display peg.

According to one aspect of the method of the present invention, the elongated device can be looped to entrap the packaged merchandise by: (a) closing one end of the elongated device to an intermediate position thereon, or (b) tying one end of the elongated device to another position thereon, or (c) fastening one end of the elongated device in the hole at an intermediate position along the elongated device, whereby the packaged merchandise is securely held in the loop thus created. According to another aspect of the method of the present invention, the step of securing the elongated device to the display peg is performed by lassoing the display peg with the elongated device. According to yet another aspect of the method of the present invention, the step of loading each of the openings of the merchandise is performed by loading the merchandise over a bevelled end of the elongated device and sliding the packaged merchandise toward a distal stop.

The disclosed a device can hold and facilitate the unloading therefrom of packaged merchandise onto a peg of a pegboard display, which in some embodiments comprises a tube segment having an open end and a closed end, a flat segment having two ends, one end of which is attached to the closed end of the tube segment and coaxial with it. The diameter of this exemplary tube segment and the width of said flat segment are substantially equal. The other end of this flat segment may be attached to a stop means, which has a width perpendicular to the common axis which is substantially greater than the diameter of the tube segment. Suitably, the device is made of a thermoplastic material, for example polyethylene.

In one embodiment of the invention, a slot is located in said flat segment proximate to its juncture with the tube segment. Suitably, the slot is substantially coaxial with said common axis, and desirably the slot is sufficiently large to permit the stop means to be passed therethrough, but once passed through, it cannot slip back through the slot without the assistance of an installer. In a variant of this embodiment, portions of the stop means extending beyond the width of the flat segment are foldable in the direction of the common axis to provide a provisional net width substantially equal to the width of the flat segment. Such a variant has two purposes. It makes it easier to slide the stop means through the slot and also enables loading to be done from the "stop" end rather than the tube end.

The scope of the invention also includes a method of providing bagged merchandise in a manner suitable for rapid loading onto peg board displays. One aspect of this method comprises the steps of loading packaged merchandise which are packaged with an opening therein, onto the device at a distribution location, and, when the merchandise arrives at the store where it is to be displayed for sale, placing the open end of the above exemplary tube segment of the device on the peg of a pegboard display device, sliding the merchandise onto the peg and removing the empty device from the peg.

In one method of loading the bagged merchandise onto the device the packaged merchandise having an opening, is slid over the open end of the tube segment of the exemplary device and the merchandise is slid up to the stop means.

Where a slot is provided in this embodiment, after loading as above, the stop means is pushed through the slot in such a manner that it is retained therein, whereby the loaded merchandise is securely held in the loop thus created.

In a variant of this embodiment, the extended, foldable, portions of the stop means device are folded to provide said narrower provisional net width, thereafter the packaged merchandise having an opening, is loaded onto said folded portions of the stop means, then the bags are slid up to but not beyond the slot, and the stop means inserted through the slot in such a manner that it is retained therein. Thus the loaded merchandise is securely held in the loop thus created by permitting said folded end to be unfolded.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DISCUSSION OF THE PREFERRED EMBODIMENTS

Figure 1:
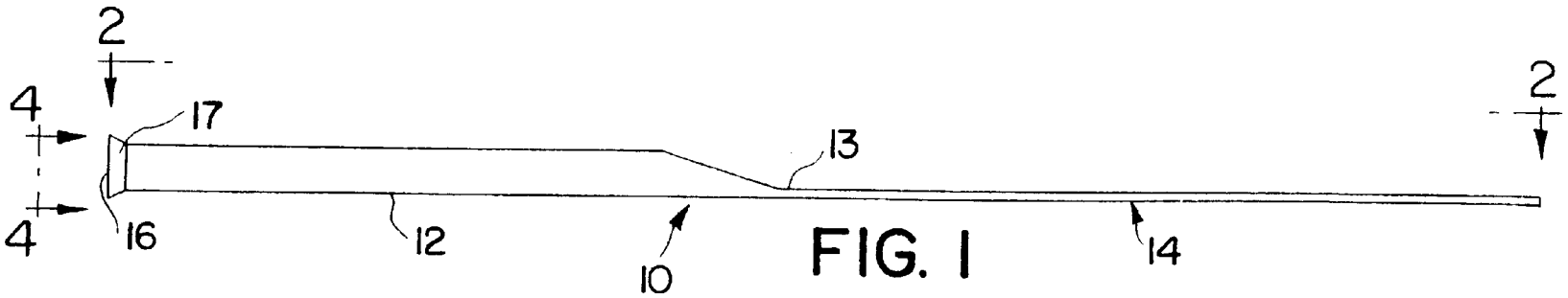
FIG. 1 is a side elevational view of a device of the present invention.
Figure 2:
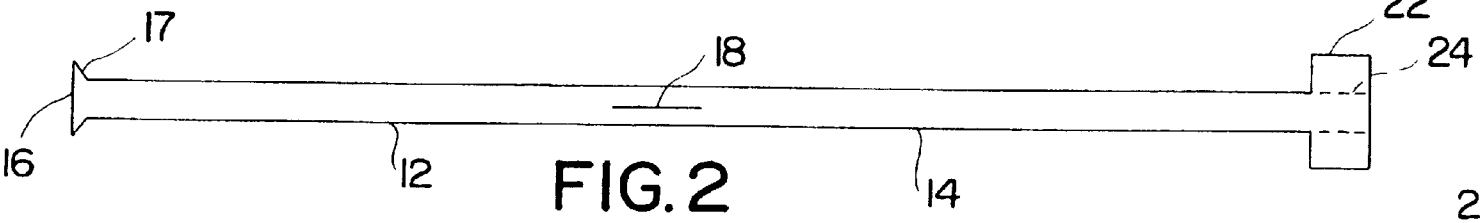
FIG. 2 is a downward plan view of a device of FIG. 1 viewed from 2—2.
Figure 3:
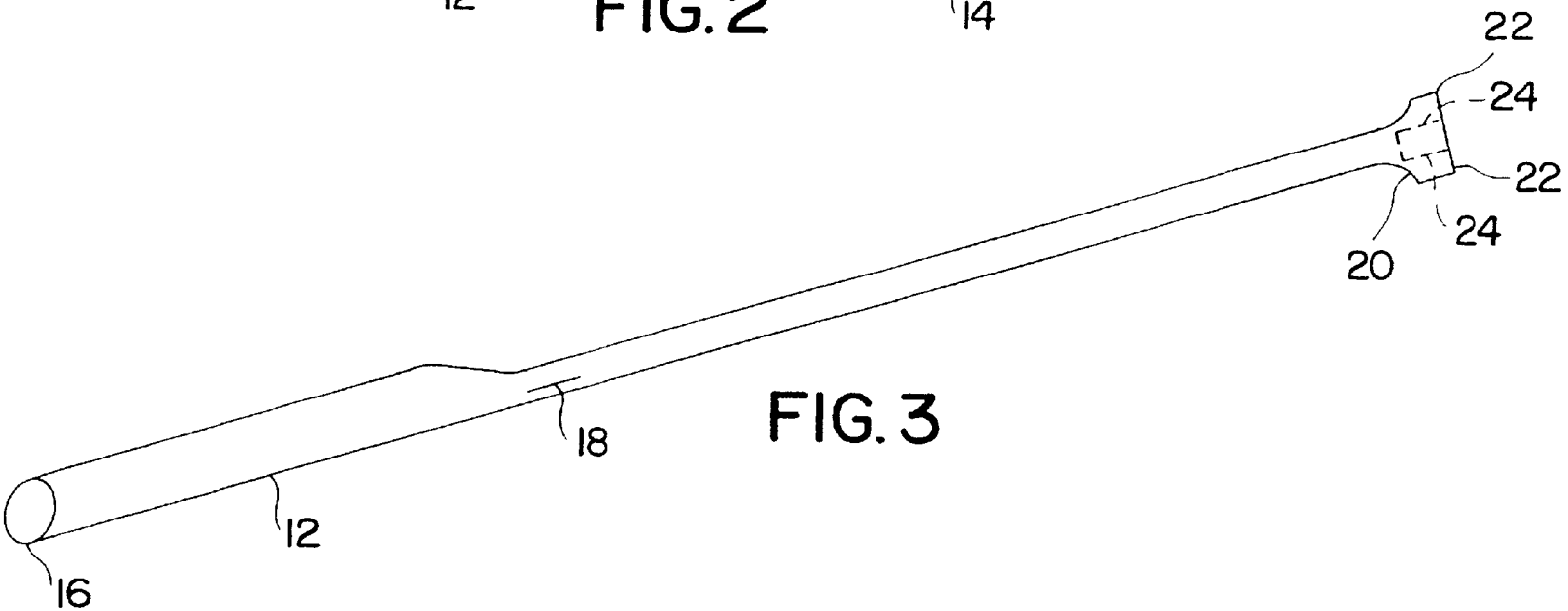
FIG. 3 is a downward perspective view of a device of FIG. 1 viewed from 2—2.

The elongated device 10, as illustrated in FIG. 1 has at its proximal end a quick release coupler, shown as hollow tubular portion 12 whose anterior opening 16 is slightly flared at 17 and is closed at closed posterior end 13, where it is tapered to join to flat segment 14 (also referred to as a stem) at whose distal end, is provided stop means 20 (also referred to as distal stop 20). Stem 14 need not be flat but may have in some embodiments a cross-section that is circular, round, polygonal, or shaped otherwise. Tubular segment 12 is shown as a sleeve with opening 16 the beginning of an internal channel.

While device 10 can be made in any dimension of width or length the preferred embodiment provides that its width is approximately 0.5 cm which also approximates to the internal diameter to section 12. Section 12 has a length of about 6 cm and segment 14 has a length of about 12.5 cm. The dimensions will vary depending upon the size of the peg, the dimensions of the packaged merchandise, and the number of packages to be held on stem 14. In still other embodiments, the tube 12 and/or its interior can be tapered to converge inwardly and thereby accommodate a variety of pegs of different sizes. At the distal end of flat segment 14 from join 13, is located stop 20. Proximal to joint 13, but located within flat portion 14 is a slot 18 (also referred to as a reentrance hole) which is, preferably, placed coaxially with the tubular and flat portions of the device. The length of slot 18 is so provided that stop 20 (which is flat) can be inserted through it and, due to the twist provided by such an insertion, will not pull out of slot 18 by itself, but can readily be taken out of said slot by an installer of the device. Accordingly the slot 18, cooperating with stop 20 acts as a securing means for releasably securing packaged merchandise.

In the preferred embodiment, fold lines, grooves or other means of facilitating folding, are placed at 24, so that the protruding ends 22 of stop 20 can be folded inwardly to provide a width substantially equal to that of flat portion 14.

Packaged merchandise is generally provided in bags 50 having a tab portion 54 having a slot or opening 52 therein and a container portion 56 attached thereto containing merchandise 58. The slot 52 is so provided that at either end 16 of device 10, or, when folded, stop 20 thereof can readily pass therethrough.

The device may be loaded in two modes. It can be loaded from end 16 and the merchandise slid towards stop 20 where it can no longer move further, or tabs 22 of stop 20 may be folded inwardly and held in that position and slot 52 of merchandise bag 50 slid thereover up to the location of slot 18.

The latter mode has the advantage that the device 10 may be held in a peg mechanism inserted into end 16 which aids in the automatic feeding of merchandise bags. While it is not essential to do so, in a preferred mode of operation, end 20 is inserted through slot 18 whereby the merchandise bag 50 is held in the loop created by flat end 14 and held in place by the tabs 22 of stop 20 now located underneath slot 18.

Figure 5:
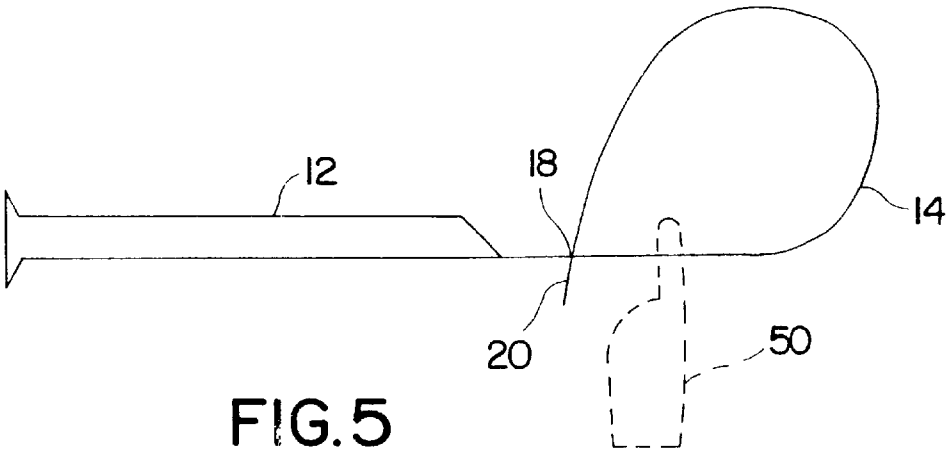
FIG. 5 is a side elevational view of a device of the present invention showing the stop placed through the slot and the loop enclosing a bag of merchandise.
Figure 4:
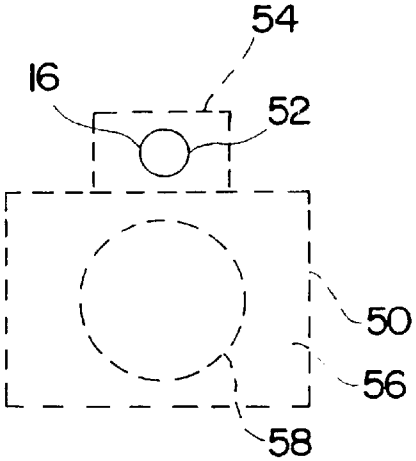
FIG. 4 is a front elevational perspective view of a device of FIG. 1 viewed from 4—4, showing, in phantom, a bag of merchandise in place.
Figure 6:
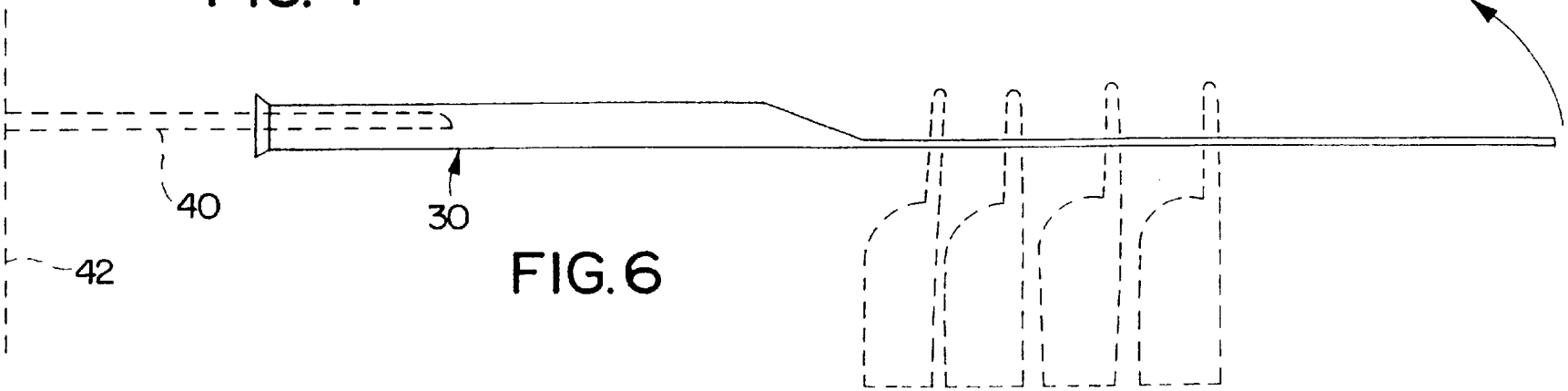
FIG. 6 is a side elevational view of a loaded device of the present invention attached to the peg of a pegboard, showing the peg and the merchandise bag in phantom.

When the loaded device of FIG. 5 is to be utilized in the field, end 16 of device 10 is slipped over display peg 40 attached to shelf wall 42 and stop 20 taken out of slot 18. The entire device is then moved upwardly in the direction of arrow A of FIG. 6 to provide a "kink" at point 30. The merchandise bag 50 and its unillustrated companions, are then slid onto peg 40. The tapering at the junction between portions 12 and 14 facilitate an easy transfer without jamming or catching. When the device is empty, the device 10 is removed and if desired, discarded. The upward motion to provide the "kink" at 30 set forth above, is not critical to the use of the invention, it merely makes operation simpler, since the merchandise bags 20 can be slid in a downward direction rather than merely in a horizontal one.

Figure 7:
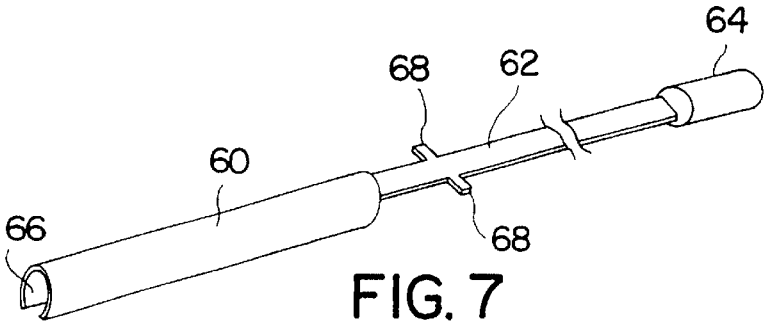
FIG. 7 is an axonometric view of a device that is an alternate to that of FIG. 1.

Referring to FIG. 7, an alternate device is shown having a coupler 60 in the form of a split tube designed to snap over a display peg. One end of coupler 60 is shown connected to stem 62. Stem 62 has at its distal end a cylindrical plug 64 that is sized to fit into the anterior opening 66 of the coupler 60. Arranged in this fashion, the device of FIG. 7 can be closed into a loop to trap merchandise that may be placed on the stem 62.

This embodiment has a proximal stop shown as a pair of flexible stubs 68. With merchandise placed on stem 62, stubs 68 can impede merchandise from sliding past the stubs 68, over coupler 60, and off the device. Stubs 68 are, however, flexible and will still allow merchandise to slide pass the stubs when sufficient force is applied to the merchandise. Thus stubs 68 are useful when storing merchandise on stem 62 and for preventing premature release of merchandise when either loading or unloading merchandise.

In some embodiments, plug 64 can be replaced with a large stop, in which case, the stem 62 will not be formed into a loop, but merchandise will be restrained between the proximal and distal stops.

Figure 8:
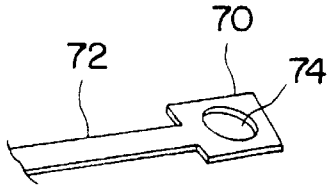
FIG. 8 is an axonometric view of a stem having an alternate distal end, which is an alternate to that of FIG. 7.

Referring to FIG. 8, an alternate distal stop 70 is it shown integral to a stem 72. Distal stop 70 is shown with a reentrance hole 74. Hole 74 is sized to fit over a coupler, for example, coupler 60 of FIG. 7. Accordingly, stem 72 can be looped back onto itself to trap merchandise that may be placed on the stem 72.

Figure 9:
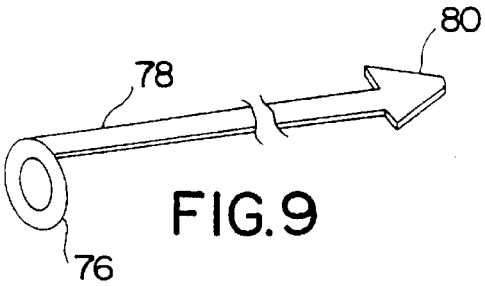
FIG. 9 is an axonometric view of a device that is an alternate to that of FIG. 1.

Referring to FIG. 9, another device is shown with an elastic, annular coupler 76. Coupler 76 is sized to fit snugly over a display peg, but not so tightly that the coupler cannot be easily removed. Annular coupler 76 is shown attached to stem 78, whose distal end terminates in a barbed plug 80. In this embodiment, plug 80 is sufficiently wide to also act as a stop.

Plug 80 is shaped like an arrow and is sized to be inserted through the center of annular coupler 76. Stem 78 thus can form a loop that will trap merchandise placed on stem 78. Because coupler 76 is elastic, plug 80 can be quickly pulled from the coupler 76. Thereafter, coupler 76 can be readily placed on a display peg to load merchandise thereon. Then, the coupler 76 can be quickly pulled from the display peg by pulling on stem 78.

Figure 10:
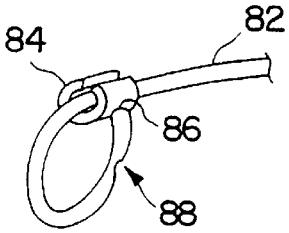
FIG. 10 is an axonometric view of an coupler which is an alternate to that shown in FIG. 1, and shown with a noose connected to a stem.

Referring to FIG. 10, an alternate device is shown with a stem 82 that is slidably fitted through a receptacle 84. The illustrated end 86 of stem 82 terminates on the side of receptacle 84. Arranged in this fashion, the illustrated end of stem 82 and receptacle 84 form a noose. This noose can be placed around a display peg and tightened by pulling stem 82 to tighten the noose. The noose can be quickly released in several ways. Since receptacle 84 is a split collar, stem 82 can be pulled upwardly to deform receptacle 84 and allow stem 82 to escape through the split in receptacle 84 and open the noose. Alternatively, a weakened, frangible section 88 is located next to end 86. Therefore, sufficient tension on stem 82 will rupture frangible section 88 to release the noose. This frangible section can be placed at various locations, including right at the end 86. in the simplest case, the noose can be released by pushing slack through the receptacle 84 to open the noose. In some embodiments, a noose may be formed by tying conventional knots.

Figure 11:
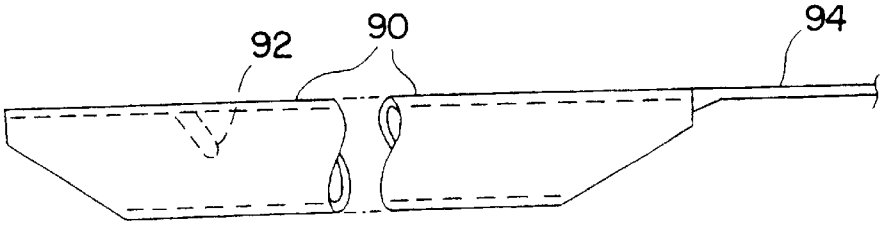
FIG. 11 is a side view of the proximal end of a device that is an alternate to that of FIG. 1.

Referring to FIG. 11, the illustrated device is shown with a coupler 90 in the form of a tubular sleeve that is open at either end. Each end of sleeve 90 is partially bevelled to facilitate insertion and removal of sleeve 90 from a display peg. For example, beveling the anterior end of sleeve 90 forms a larger opening that facilitates insertion of the sleeve onto a peg. In this embodiment, sleeve 90 is molded with an internal ratchet tooth 92. Tooth 92 is designed to allow a peg to readily slip into sleeve 90, but impede removal of the sleeve. Tooth 92 is sufficiently flexible to bend and allow removal of sleeve 92 when a user pulls hard on the sleeve 90.

Coupler sleeve 90 is shown attached to stem 94. In this embodiment, stem 94 includes a ductile wire (such as a steel wire) at least partially covered by a ribbon. Stem 94 may be structured in a fashion similar to products commonly referred to as twist-ties. Accordingly, stem 94 may be readily formed into a loop by bringing the distal end of the stem back to a position near the sleeve 90 and tying that end onto the stem. In such embodiments, the stem itself acts as a securing means.

Figure 12:
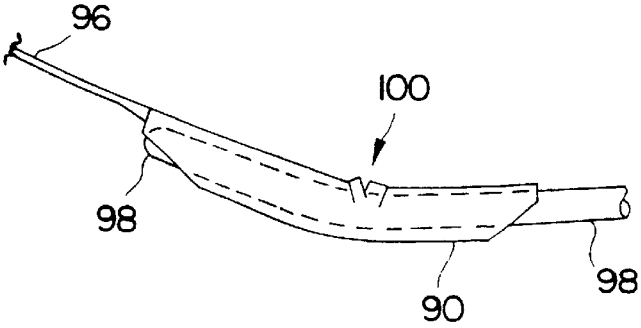
FIG. 12 is a side view of the proximal end of the device of FIG. 11, shown installed onto a display peg.

Referring to FIG. 12, previously mentioned sleeve 90 is shown fitted over a display peg 98. Sleeve 90 is shown kinked at location 100. This kinking increases the gripping of sleeve 90 onto peg 98. Also, this view shows how the posterior bevelled end of sleeve 90 facilitates removal of the device.

Obviously, many modifications and variations of the present invention are possible in light of the above teachings. It is therefore to be understood that within the scope of the appended claims, the invention may be practiced otherwise than as specifically described.

I claim:

1. A device for holding and facilitating the unloading therefrom of packaged merchandise onto a display peg, comprising a quick release coupler including an elongated tubular body having a channel which is sized and shaped such that said coupler can be slid over a display peg, said body being sufficiently flexible to permit it to kink in response to its attachment to the display peg; a stem attached to said coupler for holding packaged merchandise; and securing means for releasably securing the packaged merchandise on said stem.

2. A device according to claim 1, wherein said body is bendable from a first position, in which it is substantially straight, to a second position, in which it is bent.

3. A device according to claim 2, wherein said body has a thin-walled construction to facilitate its kinking.

4. A device according to claim 1, wherein said body has a thin-walled construction.

5. A device according to claim 1, wherein said stem is formed integrally with said coupler.

6. A device according to claim 1, wherein said stem has a first end attached to one end of said body and a second end remote from said first end, said stem being sufficiently flexible to permit its said second end to be moved into juxtaposition with an opposite end of said body, said second end of said stem including an opening which is sized and shaped so as to releasably receive said opposite end of said body when said second end of said stem is in juxtaposition with said opposite end of said body, whereby said body and said stem cooperate to form a loop which functions as said securing means.

7. A device according to claim 6, wherein said body has a unitary construction.

8. A device according to claim 6, wherein said channel extends longitudinally relative to said body.

9. A device according to claim 8, wherein said channel extends from said one end of said body to said opposite end of said body.

10. A device according to claim 8, wherein said stem is substantially flat.

11. A device according to claim 10, wherein said opening extends through said stem from one substantially planar surface thereof to an opposite substantially planar surface thereof.

12. A device according to claim 11, wherein said opening is formed in said stem adjacent to said second end thereof.

13. A device according to claim 12, wherein said second end of said stem includes a stop for inhibiting the packaged material from being removed from said second end of said stem.

14. A device according to claim 13, wherein said stem has a first width and said stop has a second width, which is greater than said first width.

15. A device according to claim 14, wherein said stop has a flat, substantially planar shape.

16. A device according to claim 14, wherein said body has a diameter which is substantially equal to said first width.

17. A device according to claim 6, wherein said opposite end of said body is beveled to thereby facilitate its attachment to the display peg.

18. A device according to claim 17, wherein said one end of said body is beveled.

19. A device according to claim 1, wherein said device is made of a thermoplastic material.

20. A device according to claim 19, wherein said thermoplastic material is polyethylne.

21. A device according to claim 1, wherein said stem has a first end attached to one end of said body and a second end remote from said first end, said stem being sufficiently flexible to permit its said second end to be moved into juxtaposition with said first end of said stem, said stem including a slot which is sized and shaped so as to releasably receive said second end of said stem when'said second end of said stem is in juxtaposition with said first end of said stem, whereby said stem forms a loop which functions as said securing means.

22. A device according to claim 21, wherein an opposite end of said body is outwardly flared.

23. A device according to claim 21, wherein said second end of said stem includes a stop for inhibiting the packaged material from being removed from said second end of said stem.

24. A device according to claim 23, wherein said stem has a first width and said stop has a second width, which is greater than said first width.

25. A device according to claim 24, wherein said stop has a flat, substantially planar shape.

26. A device according to claim 25, wherein said stop is foldable.

27. A device according to claim 1, wherein said body is a split tube.

28. A device according to claim 27, wherein said stem has a first end attached to one end of said body and a second end remote from said first end, said stem being sufficiently flexible to permit its said second end to be moved into juxtaposition with an opposite end of said body, said second end of said stem including a plug which is sized and shaped so as to be releasably receivable within said channel at said opposite end of said body when said second end of said stem is in juxtaposition with said opposite end of said body, whereby said body and said stem cooperate to form a loop which functions as said securing means.

29. A device according to claim 28, wherein said plug is cylindrical.

30. A device according to claim 28, wherein said stem includes a pair of flexible stubs extending outwardly from opposite sides of said stem.

31. A device according to claim 1, wherein said body has at least one internal ratchet tooth projecting into said channel so as to releasably grip a display peg.

32. A device according to claim 1, wherein said stem includes a ductile wire adapted for looping and tying in order to secure the packaged merchandise on said stem.

33. A device according to claim 32, wherein said stem includes a ribbon attached to, and at least partially covering, said ductile wire.

34. A device for holding and facilitating the unloading therefrom of packaged merchandise onto a display peg, comprising a quick release coupler including an opening which is sized and shaped such that said coupler can be applied to a display peg; a stem formed monolithically with said coupler for holding packaged merchandise, said stem at a first end thereof being attached to said coupler such that a second end of said stem is movable relative to said coupler; and securing means for releasably securing the packaged merchandise on said stem.

35. A device according to claim 34, wherein said coupler includes an elongated tubular body having a channel which terminates in said opening, said channel being sized and shaped such that said coupler can be slid over a display peg.

36. A device according to claim 35, wherein said body is bendable from a first position, in which it is substantially straight, to a second position, in which it is bent.

37. A device according to claim 36, wherein said body is sufficiently flexible to permit it to kink in response to its attachment to a display peg.

38. A device according to claim 37, wherein said body has a thin-walled construction to facilitate its kinking.

39. A device according to claim 38, wherein said opposite end of said body is beveled to thereby facilitate its attachment to the display peg.

40. A device according to claim 39, wherein said one end of said body is beveled.

41. A device according to claim 35, wherein said stem has a first end attached to one end of said body and a second end remote from said first end, said stem being sufficiently flexible to permit its said second end to be moved into juxtaposition with an opposite end of said body, said second end of said stem including an aperture which is sized and shaped so as to releasably receive said opposite end of said body when said second end of said stem is in juxtaposition with said opposite end of said body, whereby said body and said stem cooperate to form a loop which functions as said securing means.

42. A device according to claim 41, wherein said channel extends longitudinally relative to said body.

43. A device according to claim 42, wherein said channel extends from said one end of said body to said opposite end of said body.

44. A device according to claim 42, wherein said stem is substantially flat.

45. A device according to claim 44, wherein said aperture extends through said stem from one substantially planar surface thereof to an opposite substantially planar surface thereof.

46. A device according to claim 45, wherein said aperture is formed in said stem adjacent to said second end thereof.

47. A device according to claim 46, wherein said second end of said stem includes a stop for inhibiting the packaged material from being removed from said second end of said stem.

48. A device according to claim 47, wherein said stem has a first width and said stop has a second width, which is greater than said first width.

49. A device according to claim 48, wherein said stop has a flat, substantially planar shape.

50. A device according to claim 48, wherein said body has a diameter which is substantially equal to said first width.

51. A device according to claim 35, wherein said stem has a first end attached to one end of said body and a second end remote from said first end, said stem being sufficiently flexible to permit its said second end to be moved into juxtaposition with said first end of said stem, said stem including a slot which is sized and shaped so as to releasably receive said second end of said stem when said second end of said stem is in juxtaposition with said first end of said stem, whereby said stem forms a loop which functions as said securing means.

52. A device according to claim 51, wherein an opposite end of said body is outwardly flared.

53. A device according to claim 51, wherein said second end of said stem includes a stop for inhibiting the packaged material from being removed from said second end of said stem.

54. A device according to claim 53, wherein said stem has a first width and said stop has a second width, which is greater than said first width.

55. A device according to claim 54, wherein said stop has a flat, substantially planar shape.

56. A device according to claims 55, wherein said stop is foldable.

57. A device according to claim 35, wherein said body is a split tube.

58. A device according to claims 57, wherein said stem has a first end attached to one end of said body and a second end remote from said first end, said stem being sufficiently flexible to permit its said second end to be moved into juxtaposition with an opposite end of said body, said second end of said stem including a plug which is sized and shaped so as to be releasably receivable within said channel at said opposite end of said body when said second end of said stem is in juxtaposition with said opposite end of said body, whereby said body and said stem cooperate to form a loop which functions as said securing means.

59. A device according to claim 58, wherein said plug is cylindrical.

60. A device according to claim 58, wherein said stem includes a pair of flexible stubs extending outwardly from opposite sides of said stem.

61. A device according to claim 35, wherein said body has at least one internal ratchet tooth projecting into said channel so as to releasably grip a display peg.

62. A device according to claim 35, wherein said stem includes a ductile wire adapted for looping and tying in order to secure the packaged merchandise on said stem.

63. A device according to claim 62, wherein said stem includes a ribbon attached to, and at least partially covering, said ductile wire.

64. A device according to claim 34, wherein said coupler is an annular ring and said stem includes a barbed plug which is sized and shaped so as to be releasably receivable within said ring.

65. A device according to claim 64, wherein said barbed plug inhibits the packaged material from being removed from said stem.

66. A device according to claim 34, wherein said coupler includes a noose.

67. A device according to claim 66, wherein said noose includes a receptacle for slidably receiving said stem.

68. A device according to claim 67, wherein said receptacle is a split collar having a slot, whereby said noose can be quickly released by pulling said stem through said slot in said split collar.

69. A device according to claim 66, wherein said stem is frangible, whereby said noose can be quickly released by breaking said stem.

70. A device according to claim 34, wherein said device is molded from a thermoplastic material.

71. A device according to claim 70, wherein said thermoplastic material is polyethylene.

72. A device for holding and facilitating the unloading therefrom of packaged merchandise onto a display peg, comprising a unitary body having a first end and a second end remote from said first end, said body being sufficiently flexible to permit said second end to be moved into juxtaposition with said first end, said first end including a first opening which is sized and shaped such that said first end can be slid over a display peg, and said second end including a second opening which is sized and shaped so as to releasably receive said first end of said body when said first end is passed through said second opening to thereby form a loop in said body for releasably securing the packaged material thereto.

73. A device according to claim 72, wherein said body includes an elongated tubular section which includes said first opening and an elongated substantially flat section which includes said second opening, said flat section being attached to said tubular section such that they are movable relative to each other.

74. A device according to claim 73, wherein said tubular section is bendable from a first position, in which it is substantially straight, to a second position, in which it is bent.

75. A device according to claim 74, wherein said tubular section is sufficiently flexible to allow it to kink in response to its attachment to the display peg.

76. A device according to claim 75, wherein said tubular section has a thin-walled construction to facilitate its kinking.

77. A device according to claim 76, wherein said first opening is a channel which extends longitudinally within said tubular section.

78. A device according to claim 77, wherein said channel extends from one end of said tubular section to an opposite end of said tubular section.

79. A device according to claim 78, wherein said second opening extends through said flat section from one substantially planar surface thereof to an opposite substantially planar surface thereof.

80. A device according to claim 79, wherein said second opening is formed in said flat section adjacent to an end thereof which is remote from said tubular section.

81. A device according to claim 80, wherein said flat section includes a stop for inhibiting the packaged material from being removed from said flat section, said stop being positioned on said end of said flat section which is remote from said tubular section.

82. A device according to claim 81, wherein said flat section has a first width and said stop has a second width, which is. greater than said first width.

83. A device according to claim 82, wherein said stop has a flat, substantially planar shape.

84. A device according to claim 83, wherein said tubular section has a diameter which is substantially equal to said first width.

85. A device according to claim 84, wherein both ends of said tubular section are beveled.

86. A device according to claim 85, wherein said device Is made of a thermoplastic material.

87. A device according to claim 86, wherein said thermoplastic material is polyethylene.

* * * * *